US011680688B1

(12) United States Patent
Liu

(10) Patent No.: US 11,680,688 B1
(45) Date of Patent: Jun. 20, 2023

(54) HAND-HELD ELECTRIC DEVICE WITH CHANGEABLE HEAD

(71) Applicant: Wenjie Liu, Zhejiang (CN)

(72) Inventor: Wenjie Liu, Zhejiang (CN)

( * ) Notice: Subject to any disclaimer, the term of this patent is extended or adjusted under 35 U.S.C. 154(b) by 0 days.

(21) Appl. No.: 17/902,910

(22) Filed: Sep. 5, 2022

(30) Foreign Application Priority Data

Dec. 15, 2021 (CN) ..... 202123160805.7

(51) Int. Cl.
*F21L 4/04* (2006.01)
*F21V 31/00* (2006.01)

(52) U.S. Cl.
CPC ..... *F21L 4/045* (2013.01); *F21V 31/005* (2013.01)

(58) Field of Classification Search
CPC ..... F21L 4/005; F21L 4/04; F21L 4/045
See application file for complete search history.

(56) References Cited

U.S. PATENT DOCUMENTS 4,388,673 A * 6/1983 Maglica ..... B60Q 3/88 362/183
5,349,506 A * 9/1994 Maglica ..... F21V 31/03 362/207
5,422,798 A * 6/1995 Osiecki ..... F21V 23/0414 362/206
5,629,105 A * 5/1997 Matthews ..... F21V 23/0421 200/50.04
6,027,226 A * 2/2000 Shiau ..... F21L 15/02 362/186
7,281,815 B1 * 10/2007 Gustafson ..... F21V 23/0421 362/802
2005/0174782 A1 * 8/2005 Chapman ..... F21V 5/008 362/319
2013/0329411 A1 * 12/2013 Windom ..... F21L 4/00 362/208
2013/0335955 A1 * 12/2013 Lee ..... F21V 14/065 362/190
2020/0173629 A1 * 6/2020 Li ..... F21L 4/085

* cited by examiner

*Primary Examiner* — Zheng Song

(57) ABSTRACT

The present disclosure relates to a hand-held electric device with changeable head, includes an electrical hand-held part and a head. The electrical hand-held part has a hand-held body, an inner casing and an outer casing, the hand-held body has a first sealing ring located at the front end thereof, the inner casing is mounted at the front end of the hand-held body and the outer wall of is provided with a second sealing ring. The outer casing slides back and forth along the axis of the inner casing at the outside of the inner casing. The head includes a head body and an assembling and matching part disposed at the rear end of the head body, the assembly mating part is detachably assembled on the inner side of the inner casing, and the assembling and matching part is provided with a third sealing ring.

14 Claims, 6 Drawing Sheets

HAND-HELD ELECTRIC DEVICE WITH CHANGEABLE HEAD

FIELD OF THE INVENTION

The present disclosure relates to a field of hand-held electric device, in particular to a hand-held electric device with changeable head.

BACKGROUND OF THE INVENTION

There are many hand-held electric devices such as hand-held electric torches, hand-held work lights, hand-held fans and hand-held vacuum cleaners in current market, and heads of the hand-held electric devices are usually detachable for replacement. Such hand-held electric devices mainly include a hand-held part and a head, and the head is usually detachably mounted on the hand-held part of the electric device. For example, a hand-held electric torch is one such common hand-held electric device.

Currently, common hand-held electric torches with changeable heads in the market include a lamp head, a barrel body and a retractable sleeve. The lamp head is the head of the hand-held electric torch, and the barrel body is the hand-held part of the electric torch. The front end of the barrel body has an interface sleeve, the lamp head is detachably installed in the interface sleeve of the barrel body, and the retractable sleeve is located outside the interface sleeve and slides back and forth along the axial direction of the interface sleeve. When the lamp head needs to be replaced, it is only necessary to slide the retractable sleeve in one direction, so that the lamp head can be disassembled from the interface sleeve.

However, the above-mentioned hand-held electric torches with changeable heads also have some shortcomings: the assembly structure between the lamp head and the barrel body is not only complicated, which is inconvenient to assemble and disassemble, but also has a waterproof sealing blind area, which leads that the overall waterproof effect of the assembled lamps is poor. In addition, the above-mentioned deficiencies in the hand-held electric torches with changeable head also exist in hand-held electric appliances such as hand-held fans and hand-held vacuum cleaners.

SUMMARY OF THE INVENTION

The technical problem to be solved by the present disclosure is to provide a hand-held electric device with changeable head for the above-mentioned prior art. The hand-held electric device not only facilitates the assembly and disassembly of the head on the electrical hand-held part of the electric device, but also has better waterproof sealing effect.

The technical solution adopted by the present disclosure to solve the above-mentioned technical problems is as follows: a hand-held electric device with changeable head, including an electrical hand-held part and a head, and wherein:

The electrical hand-held part includes:

a hand-held body having a first sealing ring at its front end;

an inner casing installed on the front end of the hand-held body, and the outer side wall of the inner casing is provided with a second sealing ring;

an outer casing sleeved on the outer side of the inner casing, and can slide back and forth along an axial direction of the inner casing;

the head includes:

a head body;

an assembling and matching part arranged at a rear end of the head body, the assembling and matching part is detachably assembled in the inner side of the inner casing, and a third sealing ring is arranged on the assembling and matching part;

wherein, after the head is assembled with the electrical hand-held part of the electric device, a first sealing ring is interference fit with the inner side wall of the outer casing, a second sealing ring is interference fit with the inner side wall of the outer casing, and a third sealing ring is interference fit with the inner side wall of the inner casing.

Improved, in this disclosure, the hand-held electric device with changeable head further includes a first elastic member, the first elastic member is retractable arranged within the space formed by a front end of the hand-held body, the outer casing and the inner casing.

In a further improvement, in the hand-held electric device with changeable head, the outer casing includes:

a first sliding part being located at the front end of the outer casing, and the inner side wall of the first sliding part is interference fit with the first sealing ring;

a second sliding part being connected with the rear end of the first sliding part through the first inclined surface, the inner side wall of the second sliding part is slidably matched with the outer side wall of the inner casing, and a thickness of the side wall of the second sliding part is greater than a thickness of the side wall of the first sliding part.

In order to enable the outer casing to switch from its interference fit state with the first sealing ring to the sliding back and forth state along the axial direction of the inner casing body, it is further improved that in the hand-held electric device with changeable head, a second inclined surface matching the first inclined surface is formed on the outer side wall of the inner casing. Through the cooperation of the first inclined surface and the second inclined surface, it can ensure that the first sliding part of the outer casing can smoothly release the interference fit state with the first sealing ring, and the outer casing can freely slide back and forth in the axial direction of the inner casing.

As a way of realizing that the assembling and matching part of the head is detachably assembled inside the inner casing, and further improved, the hand-held electric device with changeable head further includes:

a sliding member, which can slide back and forth in the inner side of the inner casing;

a second elastic member being retractably arranged between the sliding member and the front end of the hand-held body;

wherein, at least one sphere limiting hole is formed in the side wall of the inner casing, the sphere limiting hole has a hard sphere, and the assembling and matching part has a groove which fits the sphere in the sphere limiting hole, and the assembling and matching part in contact with the sliding member during being assembled inside of the inner casing.

In order to ensure the stability of the electrical connection between the electrical component on which the light-emitting component is installed and the power output terminal of the power supply device, in an improved way, the hand-held electric device with changeable head further includes:

an electrical component for installing the light-emitting component, the electrical component is located on the sliding member and contacts the sliding member; wherein the sliding member is a conductive component;

a conductive third elastic member being located below the electrical piece and retractably arranged between the electrical component and the front end of the hand-held body, one end of the third elastic member is electrically connected to the electrical component, and the other end of the third elastic member is connected to the power output terminal of the power supply device in the hand-held body.

By arranging the conductive third elastic member, the electrical connection between the electrical member and the power output terminal of the power supply device can be ensured, and the elasticity of the third elastic member can be used to buffer external force that applied to the electrical component and the power output terminal of the power supply, such external force may cause adverse effect of the electrical connection between the electrical component and the power output terminals of the device, in this way enhancing the stability of the electrical connection between the electrical component and the power output terminal.

In a further improvement, in the hand-held electric device with changeable head, the second elastic member is a conductive elastic member. The conductive second elastic member provided here has the same effect as the third elastic member, which can not only achieve the effect of conductive connection, but also buffer the adverse effect of external force on the electrical connection and enhance the stability of the electrical connection.

Still further improved, in this disclosure, the hand-held electric device with changeable head further includes:

a first base, located in the inner side of the sliding member, the first base is formed with a first inner cavity, and one end of the electrical component is located in the first inner cavity;

a second base being located in the inner side of the sliding member and is arranged at the lower end of the first base, the second base is formed with a second inner cavity; wherein, the third elastic member is retractably arranged in the space formed by the first inner cavity and the second inner cavity.

Optionally, in this disclosure, the hand-held electric device with changeable head is a hand-held electric torch or a hand-held work light or a hand-held fan or a hand-held vacuum cleaner.

Compared with the prior art, the advantages of the present disclosure are:

First of all, in this disclosure, an assembling and matching part is provided on the head of the hand-held electric device, and the assembling and matching part has a third sealing ring with a waterproof effect. The electrical hand-held part has outer casing, inner casing and hand-held body, the assembling and matching part can be detachably installed on the inner casing of the electrical hand-held part, and the hand-held body has a waterproof first sealing ring in interference fit with the inner side wall of the outer casing. The inner casing has the waterproof second sealing ring in interference fit with the outer casing. In this way, after the head is assembled with the electrical hand-held part, the three sealing rings respectively realize the interference fit with the corresponding matching structures, and realize watertight seals in multiple positions of the electric device.

Secondly, through the detachable assembly and cooperation between the assembling and matching part of the head and the inner casing of the electrical hand-held part, the assembly structure is simplified, and the installation and removal of the head on the electrical hand-held part of the electric device is convenient.

DETAILED DESCRIPTION OF PREFERRED EMBODIMENTS

The present invention will be further described in detail below with reference to the embodiments of the accompanying drawings.

Figure 1:
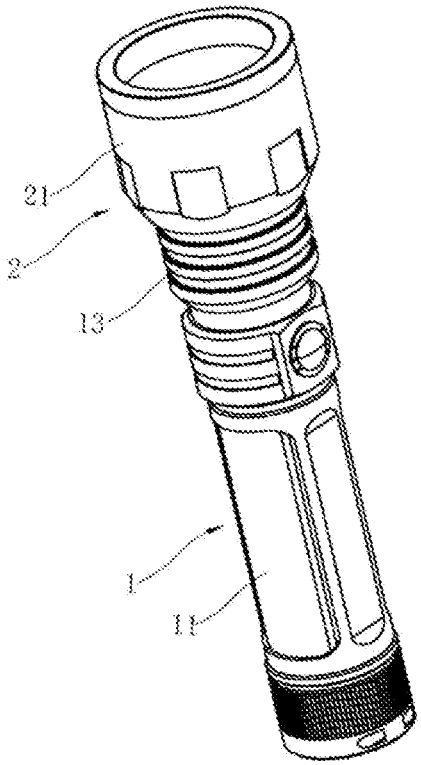
FIG. 1 is a schematic structural view of an electric torch with changeable lamp head according to an embodiment of the present disclosure.
Figure 2:
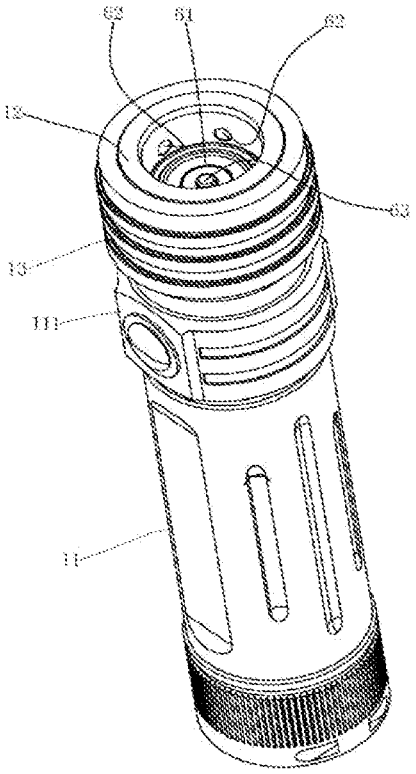
FIG. 2 is a schematic view of the barrel structure of the electric torch shown in FIG. 1.
Figure 3:
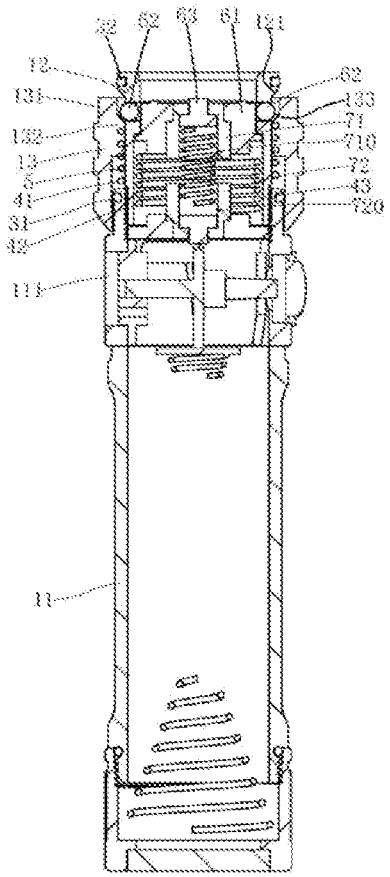
FIG. 3 is a sectional view of the barrel shown in FIG. 2.

This embodiment provides a hand-held electric device with changeable head, in particular an electric torch with changeable lamp head. Referring to FIGS. 1 to 6, the electric torch of this embodiment includes an electrical hand-held part 1 and a head 2, the electrical hand-held part 1 is the barrel body of the electric torch, and the head 2 is the lamp cap of the electric torch. In particular:

Referring to FIGS. 2-3, the electrical hand-held part 1 of this embodiment has a hand-held body 11, an inner casing 12 and an outer casing 13. The hand-held body 11 has a waterproof first sealing ring 31 at its front end, and the inner casing 12 is installed on the front end of the hand-held body 11. The outer side wall of the inner casing 12 is provided with a waterproof second sealing ring 32. The outer casing 13 is slidable back and forth along an axial direction of the inner casing 12.

Figure 4:
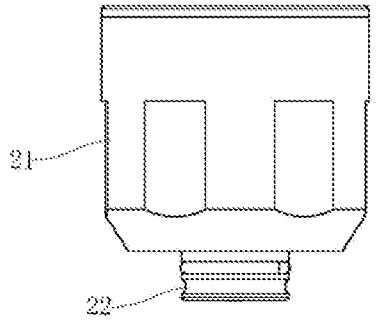
FIG. 4 is a schematic structural view of the lamp head of the electric torch shown in FIG. 1.
Figure 5:
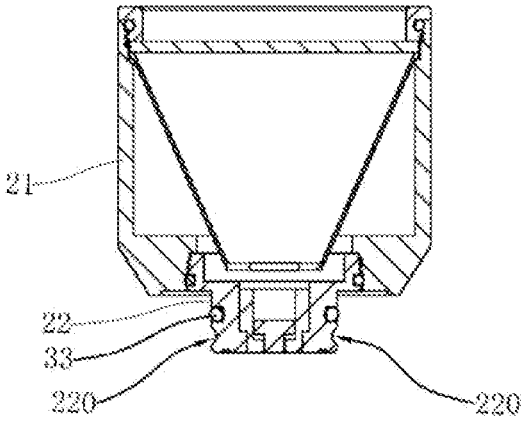
FIG. 5 is a sectional view of the lamp head shown in FIG. 4.
Figure 6:
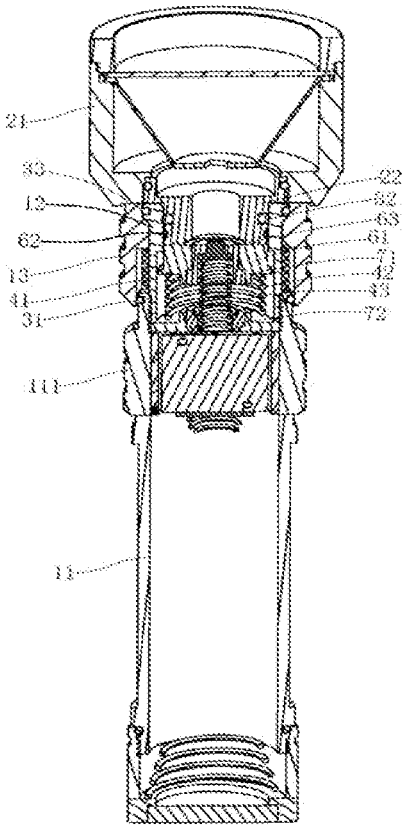
FIG. 6 is a sectional view of the electric torch shown in FIG. 1.

Referring to FIGS. 4-5, the head 2 of this embodiment has a head body 21 and an assembling and matching part 22, the head body 21 is equipped with a lamp bowl and a light-emitting part, and the assembling and matching part 22 is arranged at a rear end of the head body 21. The assembling and matching portion 22 is detachably assembled inside the inner casing 12, and the assembling and matching part 22 is provided with a waterproof third sealing ring 33. In particular, when the head 2 is assembled with the electrical hand-held part 1, the first sealing ring 31 is interference fit with the inner side wall of the outer casing 13, the second sealing ring 32 is interference fit with the inner side wall of the outer casing 13, and the third sealing ring 33 is interference fit the inner side wall of the inner casing 12.

In the sliding setting of the outer casing, the electric torch of this embodiment further includes a first elastic member 41, and the first elastic member 41 is retractably arranged in the space 51 formed by the front end of the hand-held body 11, the outer casing 13 and the inner casing 12. In addition, the outer casing 13 includes a first sliding part 131 and a second sliding part 132, the first sliding part 131 is located at the front end of the outer casing 13, and the inner side wall of the first sliding part 131 is interference fitted with the first sealing ring 31. The second sliding part 132 is connected to the rear end of the first sliding part 131 by a first inclined surface 133, the inner side wall of the second sliding part 132 is slidably matched with the outer side wall of the inner casing 12, and the thickness of the sidewall of the second sliding part 132 is greater than the thickness of the sidewall of the first sliding portion 131. Corresponding to the outer casing 13, a second inclined surface 121, which matches the first inclined surface 133, is formed on the outer side wall of the inner casing 12 of this embodiment. Through the cooperation of the first inclined surface 133 and the second inclined surface 121, the outer casing 13 is prevented from being separated from the hand-held body 11, and the first sliding part 131 of the outer casing 13 can be smoothly released from the interference fit with the second sealing ring 32. In this state, the outer casing 13 can freely slide back and forth in the axial direction of the inner casing.

Furthermore, see FIGS. 2 and 3, in this embodiment, the inner side of the inner casing 12 is provided with a conductive sliding member 61 slidable back and forth, and the sliding member 61 is provided with an electrical component 63 for installing the light-emitting member. In addition, the second elastic member 42 is retractably disposed between the sliding member 61 and the front end of the barrel body 11, and a third elastic member 43 is retractably disposed between the electrical member 63 and the front end of the barrel body 11, and the third elastic member 43 is located below the electrical component 63. The second elastic element 42 and the third elastic element 43 are both conductive springs, one end of the third elastic element 43 is electrically connected to the electrical component 63, and the other end of the third elastic element 43 is connected to the power output terminal of the power supply device in the barrel body 11. In this way, the conductive third elastic member 43 is used to realize the thimble mode conduction between the electrical member 63 and the power output terminal of the power supply device, and the self-elasticity of the third elastic member 43 can buffer the external force, such external force may causes adverse effect of the connection stability between the electrical member the power output terminals of the power supply device, thus enhancing the stability of the electrical connection between the electrical component and the power output terminals of the power supply device. A plurality of sphere limiting holes 120 are formed on the side wall of the inner casing 12, and the sphere limiting holes 120 have a hard sphere 62, for example, and the sphere 62 is a steel sphere. The assembling and matching part 22 has groove 220, the sphere 62 in the sphere limiting hole 120 is inserted into the groove 220, and the assembling and matching part 22 interferes with the sliding member 61 during being assembled inside the inner casing 12.

Referring to FIG. 3, in this embodiment, a first base 71 and a second base 72 are provided in the inner side of the sliding member 61, the second base 72 is located at the lower end of the first base 71, and the first base 71 is formed with a first inner cavity 710, one end of the electrical component 63 is located in the first inner cavity 710, and the other end of the electrical component 63 is located outside the first inner cavity 710. The second base 72 is formed with a second inner cavity 710, and the third elastic component 43 is retractably arranged in the space formed by the first inner cavity 710 and the second inner cavity 720.

Combining FIGS. 2 to 6, the following will illustrate the use process of the electric torch with changeable head in this embodiment:

When the head 2 (i.e., the lamp cap) needs to be installed on the electrical hand-held part 1 (i.e., the barrel body), a pressing force is applied to the head 2, so that the assembling and matching part 22 of the head 2 is inserted into the inner side of the inner casing 12, the assembling and matching part 22 presses the sliding member 61 toward the rear end of the electrical hand-held part 1, the sliding member 61 presses the third elastic member 43, the assembling and matching part 22 moves down with the sliding part 61, and the assembling and matching part 22 (specifically the side wall of the assembling and matching part 22) presses the sphere 62 in the sphere limiting hole 120 into the sphere limiting hole 120, and with the release of the pressing force applied to the head 2, the sliding member 61 will moves upward under the elastic reset movement of the third elastic member 43, and the sliding member 61 drives the assembling and matching part 22 to move upward. During the upward movement of the assembling and matching part 22, when the groove 220 on the assembling part 22 moves to a position flat with the sphere limiting hole 120, the outer casing 13 is pushed by the first elastic member 41, and the first inclined surface 133 pushes the sphere in the sphere limiting hole 120 into the groove 220 of the assembling and matching part 22 in a translational manner, then, the second sliding part 132 bears against the corresponding sphere in the groove 220. At this time, the assembling and matching part 22 is stuck by the stuck sphere 62 and cannot continue to move upward, thus, the assembling and matching part 22 is firmly installed on the electrical hand-held part 1. At this time, the third sealing ring 33 on the assembling and matching part 22 is in interference fit with the inner side wall of the outer casing 13, the second sealing ring 32 is in interference fit with the inner side wall of the outer casing 13, the third sealing rings 33 are in interference fit with the inner side wall of the inner casing 12 to achieve waterproof sealing at multiple positions of the appliance.

When the head 2 needs to be detached from the electrical hand-held part 1, a pull-down force can be applied to the outer casing 13, so that the first sliding part 131 of the outer casing 13 releases the interference fit with the first sealing ring 31, and the first sliding part 131 continues to move downward through the cooperation of the first inclined surface 133 and the second inclined surface 121, the second sliding part 132 of the outer casing 13 also moves downward, and the first elastic member 31 is compressed, so that the second sliding part 132 releases the interference to the sphere 62 in the sphere limiting hole 120, during this process, the sliding member 61 is always subjected to the elastic restoring force of the third elastic member 43 (that is, the third elastic member 43 pushes against the sliding member 61 towards the assembling and matching part 22), since the second sliding portion 132 no longer interferes with the sphere 62 in the sphere limiting hole 120, the sphere 62 will move to the sphere limiting hole 120 under the pressing action of the inner wall of the groove 220 of the assembling and matching part 22. At this time, the sphere 62 no longer exists in the groove 220 of the assembling and matching part 22, that is, the assembling and matching part 22 is no longer blocked by the sphere 62, so that the assembling and matching part 22 moves upward with the sliding member 61, until the assembling and matching part 22 is moved to the outside of the inner casing 12, so as to realize the effect that the head 2 is detached from the electrical hand-held part 1 of the electric device. Then, due to the push force of the sliding member 61, the spheres move outward in a translational manner toward to the outside of the inner casing 12, and the sliding member 61 will always bear against the sphere. After the pull-down force applied to the outer casing 13 is released, the outer casing 13 will move up again under the action of the elastic restoring force of the first elastic member 31, since the sphere has been pushed out of the inner casing 12 and is against by the sliding member 61, in this way, the first inclined surface 133 of the outer casing 13 will be blocked by the sphere located outside the inner casing 12 and cannot be moved upward, thereby realizing the disassembly of the head. In particular, FIG. 3 shows schematic cross-sectional barrel structure of the electric torch after the head is removed.

In this way, the assembly, disassembly and separation between the head 2 and the electrical hand-held part 1 can be conveniently completed through the cooperation between the assembly and matching portion 22 of the head 2 and the electrical hand-held part 1.

Of course, the above-mentioned hand-held flashlight can also be replaced with a hand-held work light or a hand-held fan or a hand-held vacuum cleaner according to actual needs. The corresponding head is the head of the replaced hand-held electric device, and the corresponding electrical hand-held portion is the hand-held portion of the replaced hand-held electric device.

What is claimed is:

1. A hand-held electric device with changeable head, comprising an electrical hand-held part (1) and a head (2), wherein:

the electrical hand-held part (1) comprises:

a hand-held body (11) having a first sealing ring (31) at a front end thereof;

an inner casing (12) installed on the front end of the hand-held body (11), and an outer side wall of the inner casing (12) is provided with a second sealing ring (32);

an outer casing (13) sleeved on the outer side of the inner casing (12) so as to slide back and forth along an axial direction of the inner casing (12);

the head (2) comprises:

a head body (21);

an assembling and matching part (22) arranged at a rear end of the head body (21), and the assembling and matching part (22) is detachably assembled inside the inner side of the inner casing (12), and a third sealing ring (33) is arranged on the assembling and matching part (22);

wherein, after the head (2) is assembled with the electrical hand-held part (1), the first sealing ring (31) is interference fit with the inner wall of the outer casing (13), the second sealing ring (32) is interference fit with the inner side wall of the outer casing (13), and the third sealing ring (33) is interference fit with the inner side wall of the inner casing (12).

2. The hand-held electric device with changeable head according to claim 1, further comprising:

a sliding member (61) slidably arranged in the inner side of the inner casing (12);

a second elastic member (42) retractably disposed between the sliding member (61) and the front end of the hand-held body (11);

wherein, at least one sphere limiting hole (120) is formed in the side wall of the inner casing (12), the sphere limiting hole (120) comprises hard sphere (62), and the assembling and matching part (22) comprises groove (220) for the sphere (62) in the sphere limiting hole (120) to be snapped into, and the assembling and matching part (22) is in contact with the sliding member (61) during being assembled inside of the inner casing (12).

3. The hand-held electric device with changeable head according to claim 2, further comprising:

an electrical component (63) for installing a light-emitting component, the electrical component (63) located on the sliding member (61) and contacting the sliding member (61), wherein the sliding member (61) is a conductive member;

a conductive third elastic member (43) located below the electrical member (63) and being retractably arranged between the electrical member (63) and the front end of the hand-held body (11), one end of the third elastic member (43) being electrically connected to the electrical member (63), and the other end of the third elastic member (43) being connected to the power output terminal of the power supply device in the hand-held body (11).

4. The hand-held electric device with changeable head according to claim 3, further comprising:

a first base (71) located in the inner side of the sliding member (61), the first base (71) being formed with a first inner cavity (710), one end of the electrical component (63) being located in the first inner cavity (710);

a second base (72) being located in the inner side of the sliding member (61) and arranged at the lower end of the first base (71), the second base (72) being formed with a second inner cavity (720); wherein, the third elastic member (43) is retractably arranged in the space formed by first inner cavity (710) and the second inner cavity (720).

5. The hand-held electric device with changeable head according to claim 4, wherein the hand-held electric device is hand-held electric torch or hand-held work light or hand-held fan or hand-held vacuum cleaner.

6. The hand-held electric device with changeable head according to claim 3, wherein the hand-held electric device is hand-held electric torch or hand-held work light or hand-held fan or hand-held vacuum cleaner.

7. The hand-held electric device with changeable head according to claim 2, wherein the hand-held electric device is hand-held electric torch or hand-held work light or hand-held fan or hand-held vacuum cleaner.

8. The hand-held electric device with changeable head according to claim 1, wherein the outer casing (13) comprises:

a first sliding part (131) located at the front end of the outer casing (13), and an inner side wall of the first sliding part (131) is in interference fit with the first sealing ring (31);

a second sliding part (132) connected with a rear end of the first sliding part (131) through a first inclined surface (133), an inner side wall of the second sliding part (132) is slidably matched with an outer side wall of the inner casing (12), and a thickness of the side wall of the second sliding part (132) is greater than a thickness of the side wall of the first sliding part (131).

9. The hand-held electric device with changeable head according to claim 8, wherein the outer side wall of the inner casing (12) comprises a second inclined surface (121) matching the first inclined surface (133).

10. The hand-held electric device with changeable head according to claim 9, wherein the hand-held electric device is hand-held electric torch or hand-held work light or hand-held fan or hand-held vacuum cleaner.

11. The hand-held electric device with changeable head according to claim 8, wherein the hand-held electric device is hand-held electric torch or hand-held work light or hand-held fan or hand-held vacuum cleaner.

12. The hand-held electric device with changeable head according to claim 1, further comprising a first elastic member (41), and the first elastic member (41) is retractably arranged in a space (51) formed by the front end of the hand-held body (11), the outer casing (13) and the inner casing (12).

13. The hand-held electric device with changeable head according to claim 12, wherein the hand-held electric device is hand-held electric torch or hand-held work light or hand-held fan or hand-held vacuum cleaner.

14. The hand-held electric device with changeable head according to claim 1, wherein the hand-held electric device is hand-held electric torch or hand-held work light or hand-held fan or hand-held vacuum cleaner.

* * * * *